US006196630B1

(12) United States Patent
Cheng

(10) Patent No.: US 6,196,630 B1
(45) Date of Patent: Mar. 6, 2001

(54) HORIZONTAL SWIVELLING ANGLE POSITIONING MEANS FOR A CHAIR

(75) Inventor: Ming-Chuan Cheng, Taichung (TW)

(73) Assignee: Merits Health Products Co., Ltd., Taichung (TW)

( * ) Notice: Subject to any disclaimer, the term of this patent is extended or adjusted under 35 U.S.C. 154(b) by 0 days.

(21) Appl. No.: 09/421,181

(22) Filed: Oct. 19, 1999

(30) Foreign Application Priority Data

Apr. 30, 1999 (TW) ..... 88206819

(51) Int. Cl.[7] ..... A47C 1/02
(52) U.S. Cl. ..... 297/344.22; 297/344.1
(58) Field of Search ..... 297/344.22, 344.21, 297/344.1; 248/415, 418

(56) References Cited

U.S. PATENT DOCUMENTS

| | | | | |
|---|---|---|---|---|
| 392,174 | * | 10/1888 | Koken | 297/344.22 X |
| 809,596 | * | 1/1906 | Witte | 297/344.22 X |
| 1,693,783 | * | 12/1928 | Hasselkus | 297/344.22 X |
| 2,845,990 | * | 8/1958 | Hubert | 297/344.22 X |
| 3,858,834 | * | 1/1975 | Eimen | 297/344.22 X |
| 3,964,713 | * | 6/1976 | Joslyn et al. | 297/344.22 X |
| 4,097,016 | * | 6/1978 | Petrucci | 297/344.22 X |
| 4,518,139 | * | 5/1985 | Barfell | 297/344.22 X |
| 4,520,893 | * | 6/1985 | Keough | 297/344.22 X |

FOREIGN PATENT DOCUMENTS

1448864 * 7/1966 (FR) ..... 297/344.22

* cited by examiner

*Primary Examiner*—Milton Nelson, Jr.
(74) *Attorney, Agent, or Firm*—Raymond Y. Chan; David and Raymond Patent Group

(57) ABSTRACT

Horizontal swivelling angle positioning device for a chair is disclosed. The structure consists of an axle bush with a positioning ring having a plurality of positioning slots formed radially thereof being attached to a main frame of the chair. An axle is inserted in the axle bush and sustained thereon so as to integrally engage the main frame and the chair seat. A control lever is provided to interconnect two flanks formed on the axle and sandwiches a filler block therebetween. The filler block is further locked to the control lever by a set screw so that the two components are integrally combined to turn together. A spring disposed between a stationary substrate of the chair seat and a protruded tooth of the filler block. The protruded tooth is used to be inserted into one of the positioning slots and clogged thereof by the spring so as to keep the chair in a predetermined horizontal swivelling angle. According to particular requirement of the user, the control lever may be removed to and set at a desired direction. The operation can be performed by the user who sits in a wheelchair by slightly bending down his/her head to turn the control lever without getting off the wheelchair.

1 Claim, 3 Drawing Sheets

HORIZONTAL SWIVELLING ANGLE POSITIONING MEANS FOR A CHAIR

BACKGROUND OF THE INVENTION

1. Field of the Invention

The present invention relates to horizontal swiveling angle positioning means for a chair, and more particularly, the horizontal swivelling angle positioning means for a motor driven wheelchair for disabled people.

2. Brief Description of the Prior Art

A motor driven wheelchair for disabled people or a common round chair or an armchair for the office or the family use often needs to be able to adjust its horizontal swivelling angle. However, a conventional swivel chair usually has no means to be positioned in the direction after it has been turned thereat. As for a conventional motor driven wheelchair, the horizontal swiveling positioning is simply carried out by a set screw tightened between an axle seat (or axle bush) and an axle. Positioning procedure is performed by at first slackening the set screw; swivelling the horizontal angle of the wheelchair to a predetermined direction; and then tightening the set screw. However, there are disadvantages that a tool, for example, at least a driver is required for the work that is particularly embarrassing to an aged person or a disabled one (perhaps he/she is unable to do). Besides, the rider must stand up from the wheelchair during a third person is working for him/her. In the case the swivelling angle is to be recovered to the original position, the above mentioned tedious work has to be repeated.

Besides, the work has to be done in a quite narrow working space, and the set screw is not so reliable because it is easy for it to become loose gradually caused by continuous vibration of the moving wheelchair.

In order to solve the above described problems, the applicant has carried out theoretical studies and practical experients for a long time for the present invention.

SUMMARY OF THE INVENTION

It is an object of the present invention to provide a horizontal swivelling angle positioning device for a chair which an user can conveniently and rapidly swivel the chair to a predetermined horizontal angle and position thereat without the fear of slackening.

It is another object of the present invention to a provide horizontal swivelling angle positioning device for a chair which can be positioned in the predetermined horizontal angle by simply operating a control lever whose mounted direction can be easily changed at random by the user according to his/her physical condition (a normal right-hander, a left-hander, or a one armed person). The construction is fully in compliance with human body engineering that even a disabled person can operate the control lever so easily and force savingly.

It is still another object of the present invention to a provide horizontal swivelling angle positioning device for a chair which can be tightly and reliably fixed at the adjusted position without the fear of loosening from forgetting to tight the set screw or slackening due to vibration that is likely to happen in the case a set screw is employed as tightening means.

To achieve the above mentioned object, the present invention to provide provides a horizontal swivelling angle positioning means for a chair which comprises an axle bush with a positioning ring having a plurality of positioning slots formed radially thereof being attached to a main frame of the chair. An axle is inserted in the axle bush and sustained thereon so as to integrally engage the main frame and the chair seat. A control lever is provided to interconnect two flanks formed on the axle and sandwiches a filler block therebetween. The filler block is further locked to the control lever by a set screw so that the two compoments are integrally combined to turn together. A spring disposed between a stationary substrate of the chair seat and a protruded tooth of the filler block. The protruded tooth is used to be inserted into one of the positioning slots and biased thereof by the spring so as to keep the chair in a predetermined horizontal swivelling angle. According to particular requirement of the user, the control lever may be removed to and set at a desired direction after detaching the set screw. The operation can be performed by the user who sits in a wheelchair by slightly bending down his/her head to turn the control lever without leaving the wheelchair.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
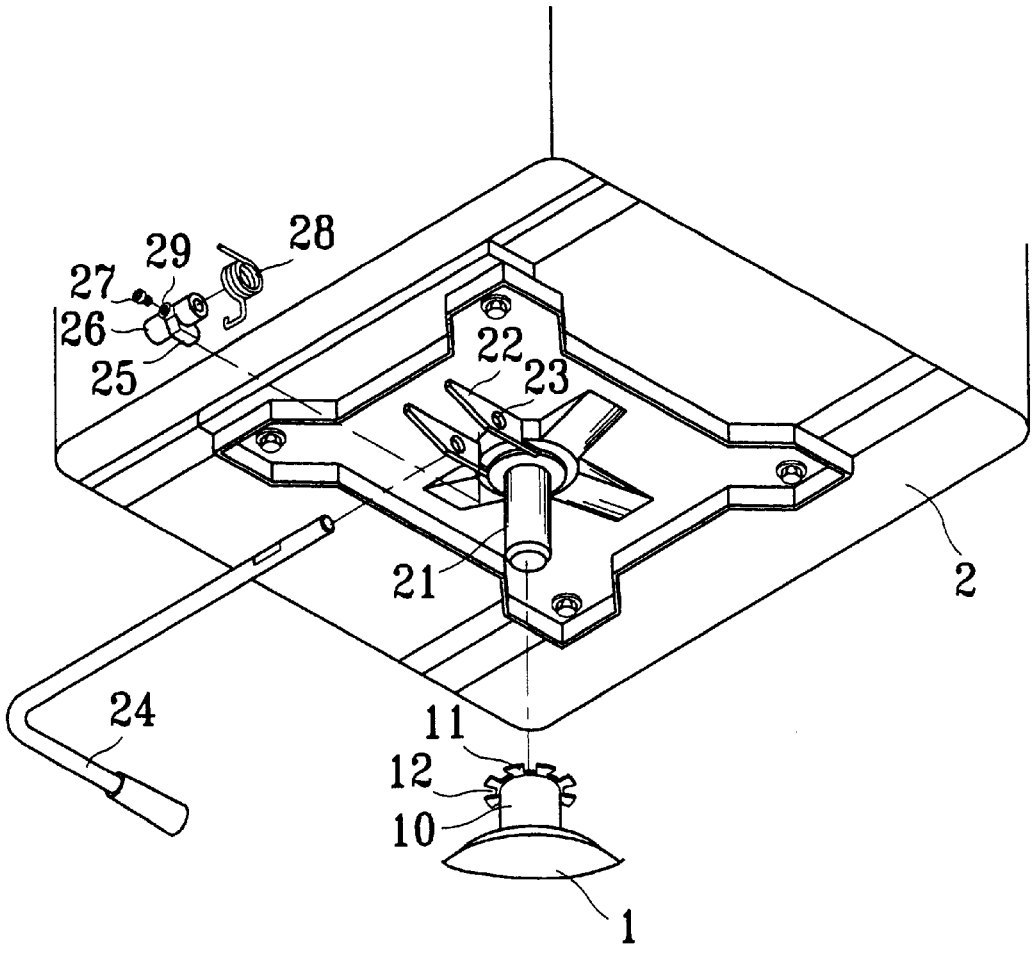
FIG. 1 is a three dimensional exploded view of horizontal swivelling angle positioning means for a chair according to the present invention.
Figure 4:
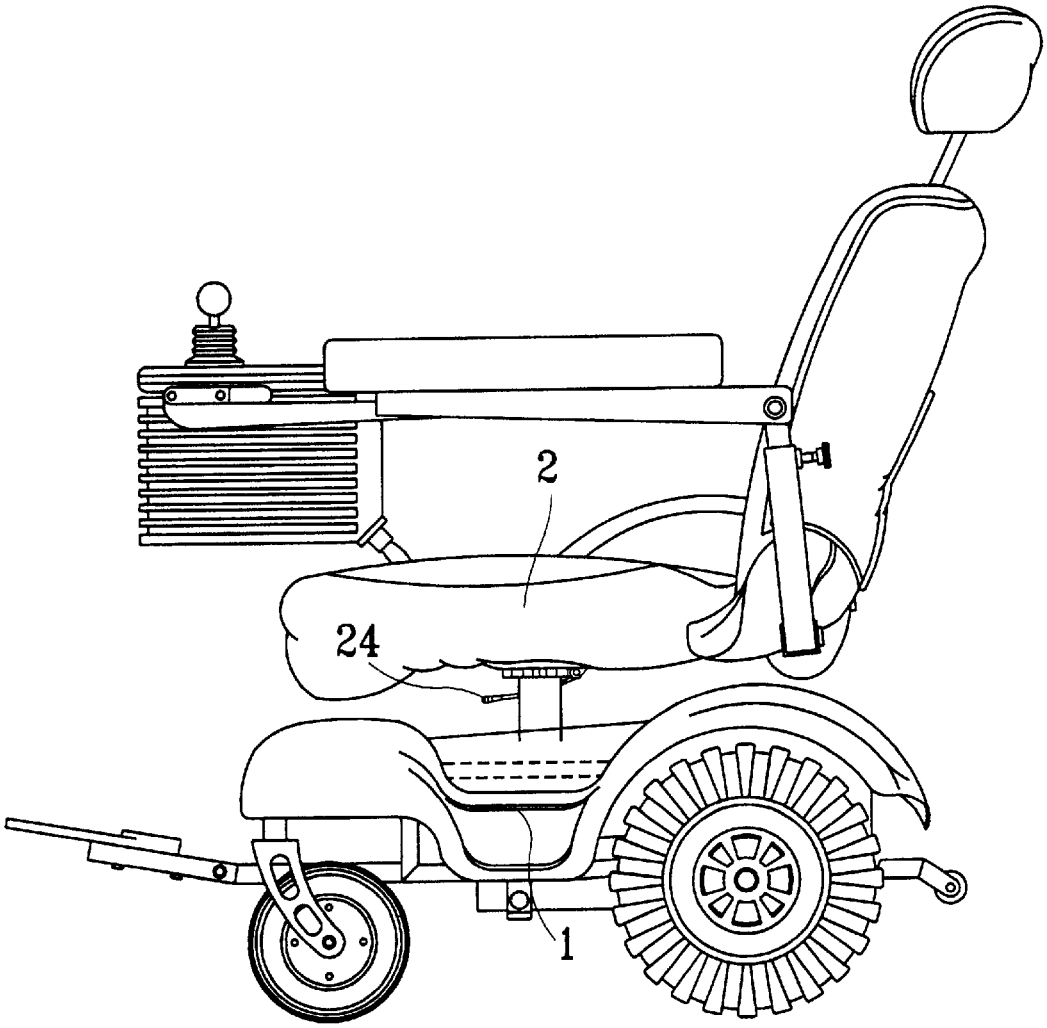
FIG. 4 is a side view of a wheelchair equipped with the horizontal swivelling angle positioning means according to the present invention.

Referring to FIGS. 1 and 4 of the drawings, a horizontal swivelling angle positioning device for a chair of the present invention is illustrated, which comprises a main frame 1 (for example, a frame of a wheelchair) with an axle bush 10 attached thereon, there is a positioning through ring 11 surrounding the circumference of the axle bush 10 with a plurality of positioning slots 12 formed radially thereof. An axle 21 is inserted in the axle bush and aligned to a stationary substrate 20 affixed to the bottom of a chair seat 2. The axle 21 inserted in the axle bush 10 is sustained thereof so as to integrally engage the chair seat 2 on the main frame 1. At the upper terminal of the axle 21 two protruded flanks 22 are downwardly and parallelly extended from the chair seat 2, each of the flanks 22 having a through hole 23 thereon for insertion of a control lever 24 therebetween. The two protruded flamks 22 sandwich a filler block 26 therebetween and coaxially aligned with the two holes 23. A screw hole 29 is bored at the bottom of the filler block 26 so as to lock the filler block 26 to the control lever 24 with a set screw 27. As a result, the filler block 26 and the control lever 24 are combined integrally to turn together. Furthermore, a spring 28, which has one end secured to a protruded tooth 25 from the filler block 26 and with its other end connected to one side of the stationary substrate 20, is disposed near the filler block 26. After the chair has been turned to a predetermined horizontal swivelling angle, the protruded tooth 25 is inserted into one of positioning through slots 12 and held thereof by a resilient force of the spring 28. Meanwhile, according to a particular requirement of the user, for example, a left-hander, or one-armed person who lost the right hand, the control lever 24 may be removed to and set at any desired position convenient to the user after detaching the set screw 27.

Figure 2:
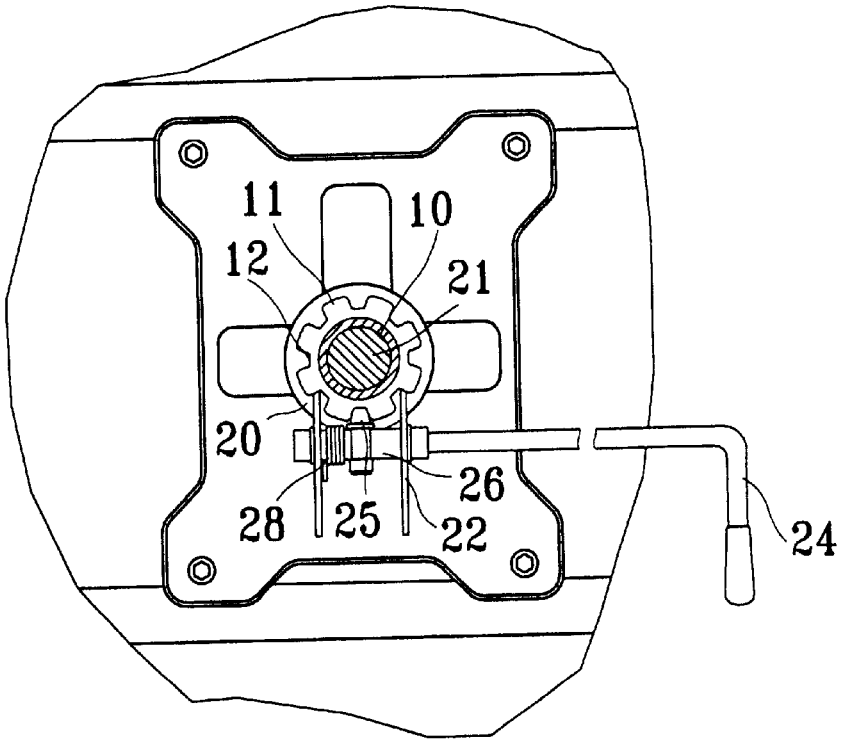
FIG. 2 is an assembled plane view of horizontal swivelling angle positioning means for a chair according to the present invention.
Figure 3:
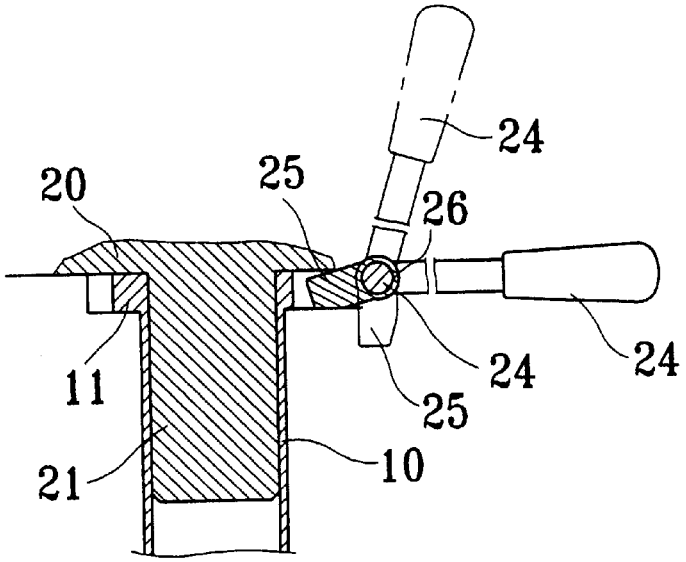
FIG. 3 is a fragmentary cross sectional view of horizontal swivelling angle positioning means for a chair according to the present invention.

Referring to FIGS. 2 and 3, both show horizontal swivelling angle positioning device of the present invention is illustrated. The protruded tooth 25 of the filler block 26 inserted in one of the positioning through slots 12 can reliably clog turning of the axle 21 which in turn prevents the chair as shown in FIG. 3 2 from swivelling. If it is desired to adjust the angle of the chair 2, the user who sits in the wheelchair only has to slightly bend down to turn the control lever 24 thereby releasing the protruded tooth 25 out of the positioning through slot 12 wherein it is inserted, and turning together with the filler block 26 to insert into another desired positioning through slot 12 so that the chair 2 may be positioned at a new angle.

As described above, the horizontal swivelling angle positioning means for a chair according to the present invention can achieve the objects of the invention mentioned in foregoing "SUMMARY OF THE INVENTION".

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A horizontal swiveling angle positioning device of a chair which comprises a chair seat mounted on a main frame, wherein said horizontal swiveling angle positioning device comprises:

an axle bush attached on top of said main frame of said chair;

a positioning ring, which is affixed at a top end of said axle bush and surrounds a circumference of said top end of said axle bush, having a plurality of positioning through slots evenly spaced with each other and radially extended outwardly;

a stationary substrate affixed to a central portion of the bottom of said chair seat;

an axle downwardly extended from said stationary substrate to insert into said axle bush so as to integrally engage said chair seat on said main frame;

two protruded flanks are positioned at an upper terminal of said axle and downwardly and parallelly extended from said bottom of said chair seat, each of said protruded flanks having a through hole thereon;

a filler block sandwiching between said two protruded flanks and being arranged to be coaxially aligned with said two through holes of said protruded flanks, said filler block comprising a protruded teeth downwardly extended therefrom and having a screw hole bored at a bottom thereof;

a control lever having one end inserting through said two through holes of said two protruded flanks and said filler block so as to support said filler block between said two protruded flanks;

a set screw screwing into said screw hole to lock said filler block to said control lever in order to combine said filler block and said control lever integrally to turn together; and a spring positioned adjacent to said filler block having one end secured to said protruded tooth from said filler block and another end connected to one side of said stationary substrate, wherein said spring is arranged to bias said protruded tooth of said filler block to downwardly insert and engage in one of said positioning through slots of said positioning ring so as to clog turning of said axle for keeping said chair seat in a predetermined horizontal swiveling angle with respect to said main frame, wherein when another end of said control lever is turned up, said control lever drives said filler block to rotate until said protruded tooth is turned out of said respective positioning through slot, said clogging of said axle is released and said chair seat is allowed to rotate to another horizontal swiveling angle position, and then by releasing said control lever, said spring drives filler block to turn down again until said protruded tooth of said filler block inserts into another one of said positioning through slots of said positioning ring.

* * * * *